US009478908B2

(12) United States Patent
Wang et al.

(10) Patent No.: US 9,478,908 B2
(45) Date of Patent: Oct. 25, 2016

(54) ELECTRICAL CONNECTOR

(71) Applicant: Tyco Electronics (Shanghai) Co. Ltd., Shanghai (CN)

(72) Inventors: Hao Wang, Shanghai (CN); Qijun Zhao, Shanghai (CN); Yuquan Chen, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/528,543

(22) Filed: Oct. 30, 2014

(65) Prior Publication Data

US 2015/0118886 A1 Apr. 30, 2015

(30) Foreign Application Priority Data

Oct. 30, 2013 (CN) ..... 2013 2 0678865 U

(51) Int. Cl.
*H01R 13/627* (2006.01)
*H01R 13/633* (2006.01)

(52) U.S. Cl.
CPC ..... *H01R 13/633* (2013.01); *H01R 13/6272* (2013.01)

(58) Field of Classification Search
CPC ..... H01R 13/6275; H01R 13/6272; H01R 13/518; H01R 13/4223; H01R 13/4362
USPC ..... 439/345, 350–358, 595, 752
See application file for complete search history.

(56) References Cited

U.S. PATENT DOCUMENTS

| | | | | |
|---|---|---|---|---|
| 5,947,763 | A * | 9/1999 | Alaksin | H01R 13/4362 439/352 |
| 6,109,955 | A * | 8/2000 | Hanazaki | H01R 13/641 439/352 |
| 6,409,534 | B1 * | 6/2002 | Weisz-Margulescu | H01R 13/6273 439/357 |
| 6,461,186 | B1 * | 10/2002 | Endo | H01R 13/641 439/352 |
| 6,524,133 | B2 * | 2/2003 | Murakami | H01R 13/4364 439/595 |
| 6,582,243 | B2 * | 6/2003 | Endo | H01R 13/6272 439/352 |
| 7,682,181 | B1 * | 3/2010 | Jones, Jr. | H01R 13/6272 439/352 |
| 8,052,458 | B2 * | 11/2011 | Rossman | H01R 13/6456 439/358 |
| 8,235,744 | B1 * | 8/2012 | Liptak | H01R 13/639 439/352 |
| 8,777,651 | B2 * | 7/2014 | Miyawaki | H01R 13/6272 439/354 |

* cited by examiner

*Primary Examiner* — Thanh Tam Le
(74) *Attorney, Agent, or Firm* — Barley Snyder

(57) ABSTRACT

An electrical connector is disclosed having a first connector and a second connector. The first connector includes a first housing, a plurality of first terminals mounted in the first housing, and a first locking member positioned outside of the first housing. The second connector has a second housing, a plurality of second terminals complementary to the plurality of first terminals, and a second locking member positioned outside of the second housing and complementary with the first locking member.

19 Claims, 3 Drawing Sheets

ELECTRICAL CONNECTOR

CROSS-REFERENCE TO RELATED APPLICATION

This application claims priority under 35 U.S.C. §199(a)-(d) to Chinese Patent Application No. 201320678865.4, dated Oct. 30, 2013.

FIELD OF THE INVENTION

The invention generally relates to an electrical connector, and more specifically to a mini electrical connector for connecting wires of an outdoor light emitting diode.

BACKGROUND

Low-power electronic equipment, such as light-emitting diode (LED) commonly uses to achieve a free-suspension connection of wire to wire by an electrical connector.

FIGS. 1-3 shows a conventional low-power electrical connector, which has a plug connector 10 and a receptacle connector 20. The plug connector 10 includes a first housing 11, two first terminals 12 extending from the first housing 11, and a first locking member 13 disposed between the two first terminals. Similarly, the receptacle connector 20 includes a second housing 21, two second terminals extending from the second housing 21, and a second locking member disposed between the second terminals. Such electrical connector is commonly used in outdoor LED illumination devices for supplying power supply and/or communicating signal to the electronic equipment. Such electrical connector is applicable to a single LED illumination device and is arranged in a thin, single row to achieve a free-suspension connection of wire to wire, and has low power and good sealing performance. Generally, such electrical connector has a thickness of about 6.5 mm, a width of about 14.5 mm, and a total connected length of about 50 mm.

The first terminals 11 may be electrically connected to the second terminals by inserting the plug connector 10 into the receptacle connector 20 while the first locking member 13 of the plug connector is engaged with the second locking member of the receptacle connector 20 so as to lock the plug connector 10 and the receptacle connector together 20. After being locked, such electrical connector has a high retaining force and meets the requirement of waterproof grade of IP67.

However, since the locking member 13 is disposed between two terminals, the total width of the electrical connector is increased. For example, as shown in FIG. 3, when two wires 14 having double-insulating layers are connected to the two terminals, longer wires 14 are necessary and need to be peeled, and ends of the two wires 14 exposed outside are separated, thus reducing the waterproof performance between the two insulating layers. This often leads to corrosive failure of the conventional electrical connector.

Therefore a need exists for an electrical connector that is smaller in size than the conventional electrical connector, and also has improved sealing performance.

SUMMARY

An electrical connector has a first connector and a second connector. The first connector includes a first housing, a plurality of first terminals mounted in the first housing, and a first locking member positioned outside of the first housing. The second connector has a second housing, a plurality of second terminals complementary to the plurality of first terminals, and a second locking member positioned outside of the second housing and complementary with the first locking member.

BRIEF DESCRIPTION OF THE DRAWINGS

The invention will now be described by way of example, with reference to the accompanying drawings, of which.

DETAILED DESCRIPTION OF THE EMBODIMENT(S)

Figure 1:
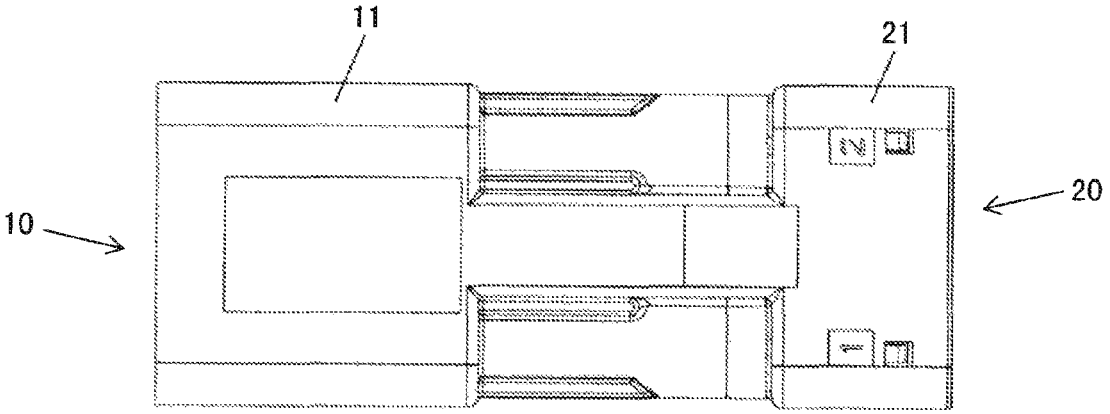
Fig. 1 PRIOR ART
FIG. 1 is a perspective view of a conventional electrical connector.
Figure 2:
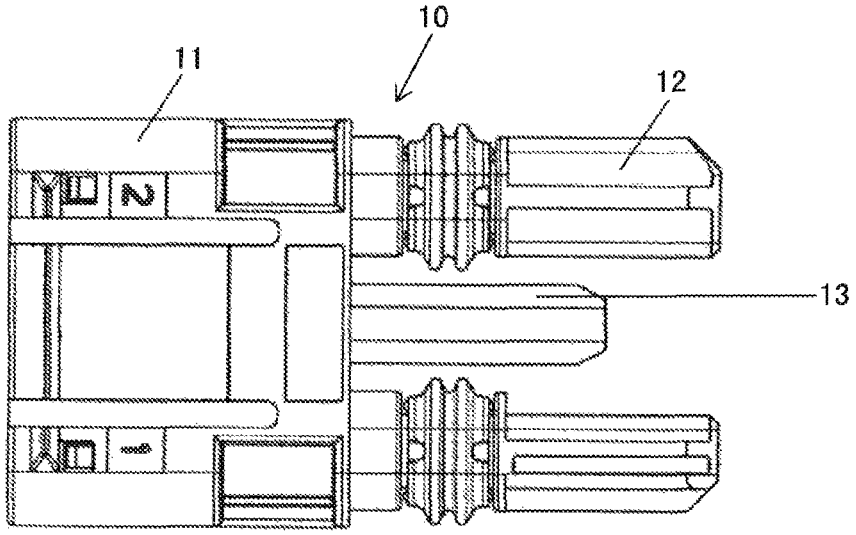
Fig. 2 PRIOR ART
FIG. 2 is a perspective view of a plug connector of the conventional electrical connector of FIG. 1.
Figure 3:
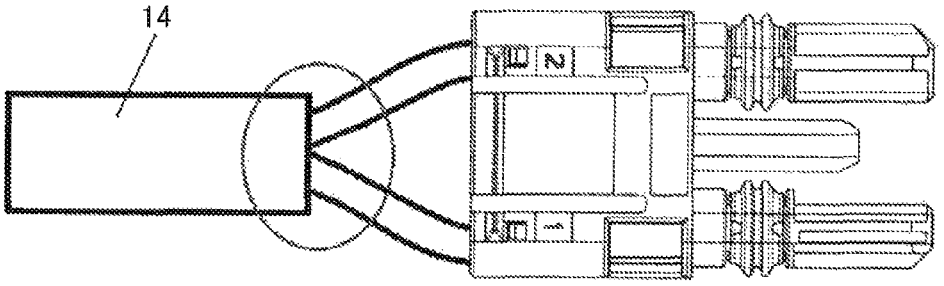
Fig. 3 PRIOR ART
FIG. 3 is a perspective view of the plug connector of FIG. 2, connected with wires of a cable.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 4:
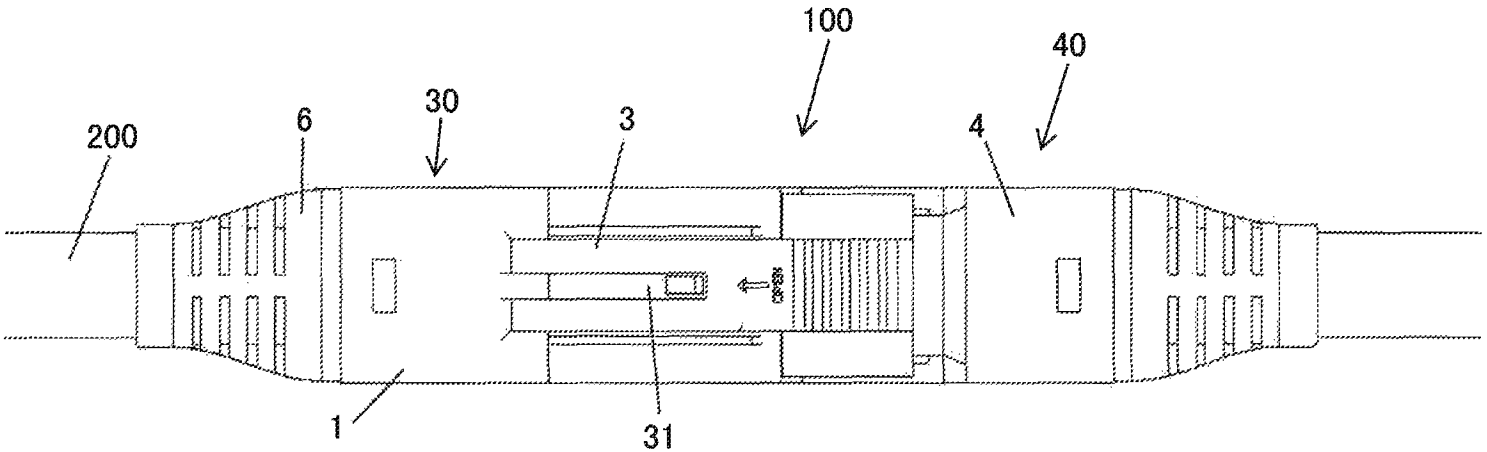
FIG. 4 is a perspective view of an electrical connector.

In the embodiment of FIG. 4, the electrical connector 100 includes a first connector 30 and a second connector 40 mated with the first connector 30. The first connector 30 has a first housing 1 made of an insulating material such as plastic, rubber or the like; a plurality of first terminals 2 mounted in the first housing 1, and a first locking member 3 disposed outside of the first housing 1. The second connector 40 has a second housing 4 made of an insulating material such as plastic, rubber or the like; a plurality of second terminals complementary to the first terminals 2 (not shown), and a second locking member 5. The second terminals are positioned to electrically connect with the plurality of first terminals 2. The second locking member 5 is disposed on an outer surface of the second housing 4 and is complementary to the first locking member 3. The second locking member 5 engages with the first locking member 3 to lock the first housing 1 and the second housing 4 together.

In an embodiment, the electrical connector 100 is applicable on electronic equipment, such as an outdoor lighting device having an LED light, for supplying power supply and/or communicating signal to the electronic equipment.

Such electrical connector 100 is applicable to a single lighting device and is arranged in a thin, single row structure to achieve a free-suspension connection of wire to wire.

In an embodiment, the first connector 30 is a plug connector, and the first terminals 2 extend from a first end of the first housing 1. The second connector 40 is a receptacle connector, and the second terminals are mounted in the second housing 4. Wires 201 of two cables 200 are respectively connected to the first terminal 2 and second terminal within the first housing 1 and the second housing 4, respectively, and extend from opposing ends of the first housing 1 and the second housing 4. When the plug connector 30 is coupled with the receptacle connector 40, the first terminals 2 are insertable into the second housing 4 and electrically connected with the second terminals disposed within the second housing 4, thus achieving an electrical connection of the two cables 200.

Figure 5:
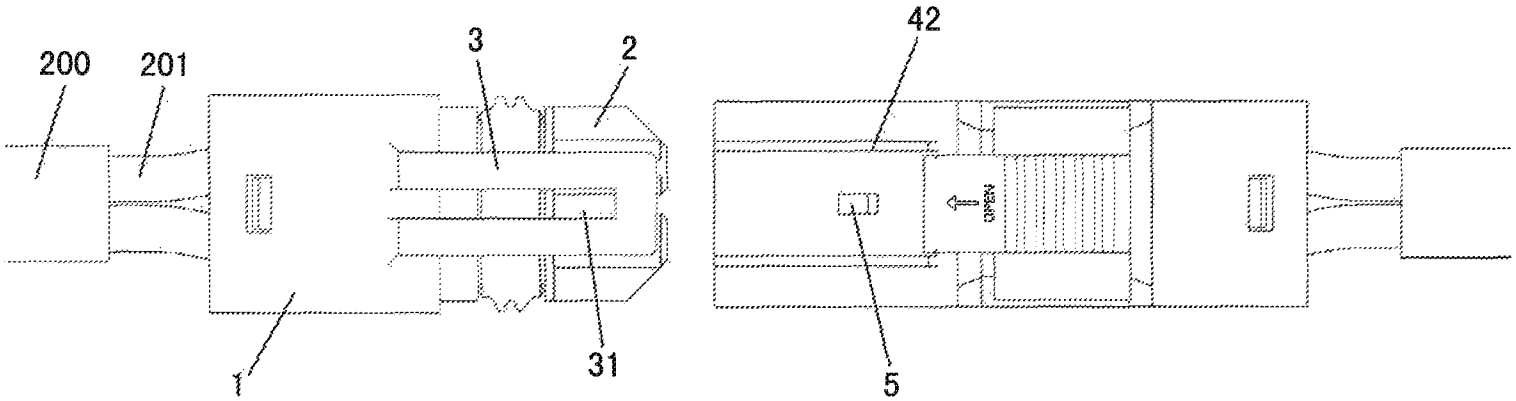
FIG. 5 is a perspective view of a plug connector separated from a receptacle connector of the electrical connector of FIG. 4.

In an embodiment of FIG. 5, the first locking member 3 is a cantilever extending in parallel to the first terminals 2. A locking portion 31 is positioned on the first locking member 3, and engages the second locking member 5 when the first terminals 2 are coupled with the second terminals. Further, the first locking member 3 includes an opening or recess.

The second locking member 5 is positioned on the outside of the second housing 4, and protrudes outward. The second locking member 5 engages the opening or recess of the first locking member 3 to lock the first locking member 3 and the second locking member 5 together.

During mating of the first connector 30 to the second connector 40, the cantilevered first locking member 3 slides along the outer surface of the second housing 4. As the first connector 30 is completely coupled onto the second connector 40, the protrusion on the second locking member 5 enters into the opening or recess in the cantilevered first locking member 3, thereby preventing the first connector 30 from being separated from the second connector. Further, the protruding second locking member 5 on the second housing 4 engages the opening or recess in the cantilever in a snap-fit manner, and a clicking sound is generated during coupling, providing a user with an auditory signal that the connection between the first and second connectors is completed.

In another embodiment (not shown), the cantilevered first locking member 3 includes a protrusion. Accordingly, the second housing 4 includes an opening or recess that engages with the first locking member's 3 protrusion. When the first connector 30 is coupled with the second connector 40, the protrusion on the cantilevered first locking member 3 is engaged with the recess on the second housing 4, thereby locking the first and second connectors 30, 40 together.

Figure 7:
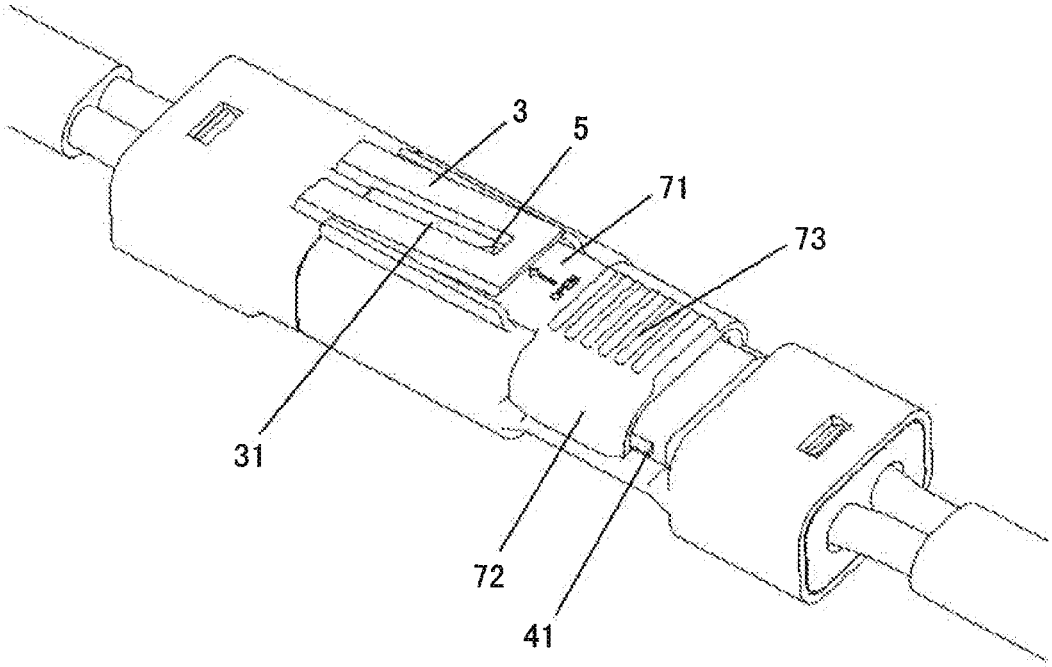
FIG. 7 is a perspective view of the electrical connector of FIG. 4 in an unlocked position.

In an embodiment of FIGS. 5 and 7, the electrical connector 100 includes an unlocking member 7 that disengages the first locking member 3 from the second locking member 5. The unlocking member 7 includes a tongue 71 positioned on a first surface of the second housing 4 (the upper surface in FIG. 7) and slidable into a position between the first housing 1 and a mating end of the cantilevered first locking member 3, to displace the mating end of the cantilevered first locking member 3 away from the first housing 1. In this way, the protruding second locking member 5 will be disengaged from the opening or recess in the cantilevered first locking member 3, so as to allow the first connector 30 and the second connector 40 to disengage from each other.

In an embodiment, at least one of an engaging end of the tongue 71 and the mating end of the cantilevered first locking member 3 is formed with a bevel structure, so that the tongue 71 is smoothly inserted between the cantilevered first locking member 3 and the first housing 1 to lift the cantilevered first locking member 3.

In an embodiment, the unlocking member 7 further comprises a body 73 and connecting members 72. The tongue 71 is connected on a mating end of the body 73 positioned towards the cantilever (the left side in FIG. 5). In an embodiment, the connecting members 72 are connected with the body 73 and slidably coupled with the second housing 4. Further, the connecting members 72 are connected with two second sides of the body 73, approximately perpendicular to the mating end, and slidably coupled with the two side surfaces of the second housing 4, approximately perpendicular to the first surface (the upper surface in FIG. 6). An end of each of the connecting members 72 is formed with at least one hook (not shown) protruding inwardly. A hook engaging flange 41 is positioned axially along each of the two side surfaces of the second housing 4. The hooks engage with the hook engaging flanges 41 to slidably mount the unlocking member 7 on the second housing 4. In an embodiment, the hook engaging flanges 41 may be protrusions axially extending along the side surfaces of the second housing 4. In another embodiment, the hook engaging flanges 41 may be upper edges of slots axially extending along the side surfaces of the second housing 4. In another embodiment, the hook engaging flanges 41 may be lower edges of the side surfaces of the second housing 4.

In an embodiment, the hooks formed on the ends of the connecting members 72 are engaged in snap-fit manner with the hook engaging flanges 41, by pressing the body 73 downward against the second housing 4. The unlocking member 7 may axially slide relative to the hook engaging flanges 41, but the hooks prevent the unlocking member 7 from being separated from the hook engaging flanges 41 in an upper-and-down direction, perpendicular to the axial direction.

In an embodiment, an unlocking member receiving recess (see FIGS. 6 and 7) is formed in a portion of the second housing 4 for mounting the unlocking member 7. When the unlocking member 7 is mounted in the receiving recess, an outer surface of the unlocking member 7 is substantially flush with a surface of the second housing 4.

In an embodiment of FIG. 4, two tongue guiding walls 42 are formed along two sides of the unlocking member receiving recess along the axial direction, to guide movement of the tongue 71 during mating of first connector 30 with the second connector 40. The two tongue guiding walls 42 flank the protrusion on the second locking member 5. Additionally, the tongue guiding walls 42 prevent the cantilevered first locking member 3 from being opened from a side thereof, thereby avoiding undesired detachment of the connectors 30, 40.

In an embodiment of FIGS. 4 and 5, the electrical connector 100 further comprises two strain relief members 6 mounted on a cable receiving end of the first housing 1 and a cable receiving end of the second housing 4. A portion of each cable 200 and wire 201 thereof passes through each cable receiving end to electrically connect with the first terminals 2 and the second terminals. In this way, the strain relief members 6 may function to protect the wires 201, and may improve seal performance of the electrical connector 100 and increase the waterproof performance.

While an embodiment has been described above, in which a first connector 30 (plug connector) includes the cantilevered first locking member 3 and a second connector 40 (receptacle connector) includes the second locking member 5 having the protrusion, the present invention is not limited thereto.

In an alternative embodiment, the second locking member may be a cantilevered and extending axially along the second housing 4 of the second connector 40. The cantilevered second locking member engages and locks onto the first locking member 3 when the first terminals 2 are connected with the second terminals. Further, the cantilevered second locking member further includes an opening or recess, and the first locking member includes a complementary protrusion formed on an outer surface of the first housing. The protrusion is insertable into the opening or recess to lock the first and second locking members together.

An operating process of the electrical connector 100 will now be described below.

Figure 6:
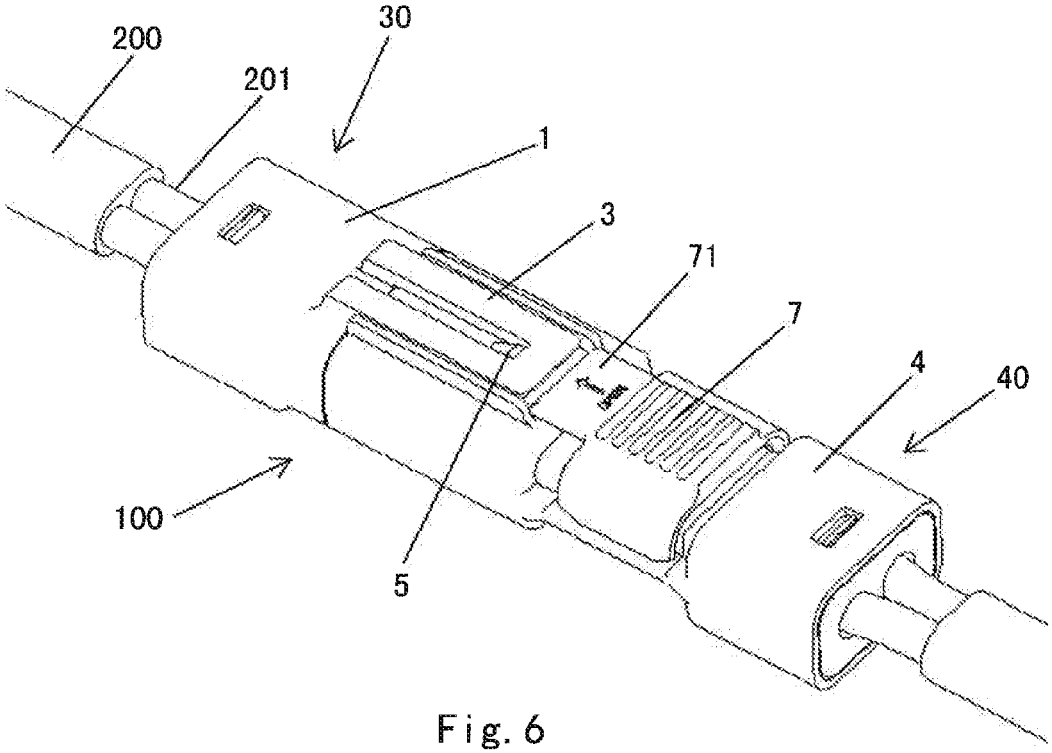
FIG. 6 is a perspective view of the electrical connector of FIG. 4 in a locked position.

Referring to the embodiments of FIGS. 5 and 6, the cantilevered first locking member 3 slides along the outer surface of the second housing 4 during coupling the first connector 30 to the second connector 40. When the first connector 30 is completely coupled with the second connector 40, the protrusion of the second locking member 5 on the second housing 4 enters into the opening or recess in the cantilevered first locking member 3, thereby preventing the first connector 30 from being separated from the second connector.

To separate the first connector 30 from the second connector 40, the body 73 of the unlocking member 7 is displaced along an axial direction, such that the tongue 71 axially slides into between the first housing 1 and the end of the cantilevered first locking member 3 to lift the end of the cantilevered first locking member 3 outward, away from the first housing 1. In this way, the protrusion on the second locking member 5 disengages from the opening or recess in the cantilevered first locking member 3. Once the protrusion has disengaged from the opening, the first and second locking members 3, 5 are released and the first connector 30 and the second connector 40 may be separated from each other.

According to various embodiments as described above, an electrical connector 100 is disclosed which is small in size and has two thin terminals of single row. Since the locking members 3, 5 of the plug connector 30 and the receptacle connector 30 are both disposed outside of their housings 1, 4 respectively, the width of the entire electrical connector is reduced over that of the conventional electrical connector. For example, the total size of the electrical connector 100 can be decreased by 30% compared to the conventional electrical connector shown in FIG. 1.

Additionally, spacing between the two terminals of the connector is reduced. In this way, when the wires of the cables are connected to the terminals, the spacing between the wires of one cable is reduced, thus improving the seal performance of the entire electrical connector as well as the waterproof performance.

The unlocking members 3, 5 facilitate a stable locking operation that reduces the possibility of unintentional unlocking. Further, the cantilevered first locking member 3 is positioned close the surface of the second housing 4 when the first connector 30 is mated to the second connector 40, further reducing the thickness of the electrical connector 100.

It would be appreciated by those skilled in the art the embodiment as described and shown above are exemplary and various changes or modifications may be made thereto. Structures described in various embodiments may be combined in any forms without conflicting with each other in structure or concept of the present invention to achieve various electrical connectors to solve the technical problem of the present invention.

After describing and showing the above embodiments, one skilled in the art would appreciate that various changes or modifications may be made in these embodiments without departing from the principle and spirit of the disclosure, and the present invention is not limited to the exemplary embodiment as described and shown above.

What is claimed is:

1. An electrical connector comprising a first connector having:

a first housing, a plurality of first terminals mounted in the first housing, and a first cantilevered locking member positioned outside of the first housing and extending in parallel to the first terminals; and a second connector having:

a second housing, a plurality of second terminals complementary to the plurality of first terminals, a second locking member positioned outside of the second housing and complementary with the first cantilevered locking member, and an unlocking member with a tongue positioned on a first surface of the second housing, and slidable into a position between the first housing and a mating end of the cantilevered first locking member.

2. The electrical connector according to claim 1, wherein the first connector is a plug connector and the first terminals extend from the first housing.

3. The electrical connector according to claim 2, wherein the second connector is a receptacle connector and the second terminals are mounted in the second housing.

4. The electrical connector according to claim 1, wherein the first cantilevered locking member engages the second locking member when the first terminals are coupled with the second terminals.

5. The electrical connector according to claim 4, wherein the first cantilevered locking member has an opening or recess.

6. The electrical connector according to claim 5, wherein the second locking member is a protrusion on an outer surface of the second housing.

7. The electrical connector according to claim 6, wherein the first cantilevered locking member is locked with the second locking member when the protrusion is inserted in the opening or recess.

8. The electrical connector according to claim 1, wherein the mating end of the first cantilevered locking member is displaced away from the first surface of the second housing when the unlocking member is positioned between the first housing and the mating end.

9. The electrical connector according to claim 8, wherein the unlocking member includes:

a body connected on a mating end to the tongue; and connecting members extending from the body and slidably coupled with the second housing.

10. The electrical connector according to claim 9, wherein the connecting portions are connected with two second sides of the body, approximately perpendicular to the mating end, and are slidably coupled with the two side surfaces of the second housing, approximately perpendicular to the first surface.

11. The electrical connector according to claim 10, wherein an end of each of the connecting members is formed with at least one hook protruding inwardly.

12. The electrical connector according to claim 11, wherein the second housing further comprises a hook engaging flange positioned axially along the two side surfaces.

13. The electrical connector according to claim 12, wherein the hooks engage with the hook engaging flanges to slidably mount the unlocking member on the second housing.

14. The electrical connector according to claim 9, wherein the second housing further comprises two tongue guiding walls formed axially along two sides of the second housing, and flanking the protrusion on the second locking member.

15. The electrical connector according to claim 1, wherein an unlocking member receiving recess is formed in a portion of the second housing.

16. The electrical connector according to claim 15, wherein the unlocking member is mounted in the unlocking member receiving recess such that an outer surface of the unlocking member is substantially flush with an outer surface of the second housing.

17. The electrical connector according to claim 1, wherein at least one end of the tongue and the end of the cantilever is beveled.

18. The electrical connector according to claim 1, further comprising two strain relief members, each mounted on a cable receiving end of the first housing and a cable receiving end of the second housing, and through which a portion of a cable and wire pass to electrically connect with the first and second terminals.

19. An electrical connector comprising:

a first connector having:

a first housing, a plurality of first terminals mounted in the first housing, and a first cantilevered locking member positioned outside of the first housing and extending in parallel to the first terminals; and a second connector having:

a second housing, a plurality of second terminals complementary to the plurality of first terminals, a second locking member positioned outside of the second housing and complementary with the first cantilevered locking member, and an unlocking member with a tongue positioned on a first surface of the second housing, and slidable into a position between the second housing and a mating end of the cantilevered first locking member.

* * * * *